US005921094A

United States Patent [19]

Bang et al.

[11] Patent Number: 5,921,094

[45] Date of Patent: Jul. 13, 1999

[54] METHODS AND APPARATUS FOR SENSING AN EXCESSIVE AMOUNT OF COLLECTED CONDENSED WATER IN AN AIR CONDITIONER

[75] Inventors: Yong-Woong Bang; Je-Myoung Moon, both of Kyungki-do, Rep. of Korea

[73] Assignee: Samsung Electronics Co., Ltd., Suwon, Rep. of Korea

[21] Appl. No.: 08/923,252

[22] Filed: Sep. 4, 1997

[30] Foreign Application Priority Data

Sep. 12, 1996 [KR] Rep. of Korea ..... 96-39521

[51] Int. Cl.[6] ..... F25B 49/02

[52] U.S. Cl. ..... 62/126; 62/129; 340/616

[58] Field of Search ..... 62/125, 126, 127, 62/128, 129, 130; 340/616, 618, 622

[56] References Cited

U.S. PATENT DOCUMENTS

| | | | |
|---|---|---|---|
| 4,037,427 | 7/1977 | Kramer | 62/128 |
| 4,633,673 | 1/1987 | Morrison et al. | 62/129 |
| 4,787,212 | 11/1988 | Hessey | 62/129 X |
| 4,937,559 | 6/1990 | Meacham et al. | 62/129 X |
| 4,998,412 | 3/1991 | Bell | 62/126 |
| 5,522,229 | 6/1996 | Stuchlik, III et al. | 62/127 |

*Primary Examiner*—Harry B. Tanner
*Attorney, Agent, or Firm*—Burns, Doane, Swecker & Mathis, L.L.P.

[57] ABSTRACT

A method of sensing condensed water of an air conditioner which is driven by a compressor motor's operation through a motor driving portion, to heat-exchange the inside, comprises the steps of—sensing temperature by means of a temperature sensor mounted within a condensed water bucket, before comparing it with a predetermined temperature set in a control portion, during the operation of the air conditioner; driving the motor driving portion in order to operate the compressor motor until the room temperature detected by the temperature sensor reaches the temperature set by a user, if the indoor temperature is above the temperature already set; and stopping the motor driving portion in order to halt the operation of the compressor motor, deciding that condensed water collects in the condensed water bucket, and displaying an error message through a display as well as generating an alarm sound through an alarm sound generating portion, if the room temperature is below the temperature already set. The room temperature and the overflow of condensed water are detected by the temperature sensor mounted within the condensed water bucket, so that the break-downs of the electric parts in the air conditioner and the damage of the floor or furniture can be prevented, thereby decreasing the cost of manufacture.

12 Claims, 6 Drawing Sheets

START
DRIVING AIR CONDITIONER
510
SENSING TEMPERATURE
520
530
BELOW PREDETERMINED TEMPERATURE?
NO
YES
STOPPING OPERATION OF AIR CONDITIONER
550
NORMAL DRIVING OF AIR CONDITIONER
540
GENERATING ALARM SOUND
560
DISPLAYING ERROR MESSAGE
570
END

METHODS AND APPARATUS FOR SENSING AN EXCESSIVE AMOUNT OF COLLECTED CONDENSED WATER IN AN AIR CONDITIONER

BACKGROUND OF THE INVENTION

1. Field of the Invention

The present invention relates to an air conditioner, and more particularly, to a device for and a method of sensing a level of condensed water collected in a container to prevent overflow thereof.

2. Discussion of Related Art

As shown in FIGS. 1 and 2, a conventional air conditioner comprises: an inlet grill member 6 mounted on the frontal lower portion of a main body 2, with a plurality of slots 4 to inlet the indoor air; a filter member 8 installed inside inlet grill member 6, for filtering impurities contained in the indoor air which is inlet through slots 4 of inlet grill member 6; an indoor heat-exchanger 10 installed inside filter member 8, for heat-exchanging the indoor air filtered by filter member 8 into cold wind or hot wind; an outlet 12 mounted on the upper portion of main body 2, for discharging the air heat-exchanged by means of indoor heat-exchanger 10; a blow fan 14 mounted over indoor heat-exchanger 10, for sending the air heat-exchanged by indoor heat-exchanger 10 to outlet 12; a duct member 16 installed around blow fan 14 so as to guide the flow of the air sent to outlet 12; and an operating portion 18 mounted on a front of main body 2, for adjusting the operating mode (automation, cooling, dehumidifying, ventilating, heating, etc.) of the air conditioner, the start and stop of operating, and the flux and wind direction of the air discharged through outlet 12.

Outlet 12 includes: a plurality of left and right wind adjusting blades 12A which cause the direction of the cold wind or hot wind heat-exchanged by indoor heat-exchanger 10 to be changed in right and left direction; and a plurality of up and down wind adjusting blades 12B which are perpendicular to left and right wind adjusting blades 12A and cause the direction of the cold wind or hot wind to be changed in up and down direction.

During the operation of the air conditioner, moisture is generated by the state change of inner devices in case of heat-exchanging through indoor heat-exchanger 10. As moisture increases, condensed water runs down from indoor heat-exchanger 10 and then collects in a condensed water bucket 100 mounted under indoor heat-exchanger 10. To remove the condensed water which collects in condensed water bucket 100, an aperture is formed in a bottom of condensed water bucket 100 and then connected with a hose in order to discharge the condensed water collecting in condensed water bucket 100 to outside.

When the aperture formed in condensed water bucket 100 is stopped up with impurities such as dust, however, the condensed water which collects in condensed water bucket 100 is not discharged to outside through the hose, continuously collecting in bucket 100, and thereby overflowing condensed water bucket 100. As a result, there may occur a shorting of electric parts inside the air conditioner. That can be the cause of break-downs and fire of the air conditioner. In addition, the condensed water which overflows condensed water bucket 100, leaks out [to inside] so that furniture or floor covered with laminated paper is damaged.

SUMMARY OF THE INVENTION

Accordingly, the present invention is directed to a device for and a method of sensing condensed water of an air conditioner, that substantially obviate one or more of the problems due to limitations and disadvantages of the related art.

An object of the present invention is to provide a device for and a method of sensing condensed water of an air conditioner in which a temperature sensor is mounted within a condensed water bucket so as to sense overflow of condensed water as well as indoor (i.e., room) temperature.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the device for sensing condensed water of the air conditioner which is driven by a compressor motor's operation through a motor driving portion, to heat-exchange the inside, comprises: a temperature sensor mounted within a condensed water bucket, for sensing the room temperature and the temperature of condensed water, in case of operation of air conditioner; and a control portion for generating a control signal which compares the temperature detected by the temperature sensor with the temperature already set, to operate or stop the compressor motor through the motor driving portion.

The device also comprises an alarm sound generating portion for generating an alarm sound in accordance with the control signal from the control portion, and a display for displaying an error message.

To achieve these and other advantages and in accordance with the purpose of the present invention, as embodied and broadly described, the method of sensing condensed water of the air conditioner which is driven by a compressor motor's operation through a motor driving portion, to heat-exchange the inside, comprises the steps of: sensing the room temperature by means of a temperature sensor mounted within a condensed water bucket, comparing it with a predetermined temperature set in a control portion, during the operation of the air conditioner; driving the motor driving portion in order to operate the compressor motor until the indoor temperature detected by the temperature sensor reaches the temperature set by a user, if the indoor temperature is above the temperature already set; and stopping the motor driving portion in order to halt the operation of the compressor motor, deciding that the condensed water bucket is full of condensed water, and displaying an error message through a display as well as generating an alarm sound through an alarm sound generating portion, if the indoor temperature is below the temperature already set.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention:

DETAILED DESCRIPTION OF PREFERRED EMBODIMENT

Reference will now be made in detail to the preferred embodiments of the present invention, examples of which are illustrated in the accompanying drawings.

Figure 1:
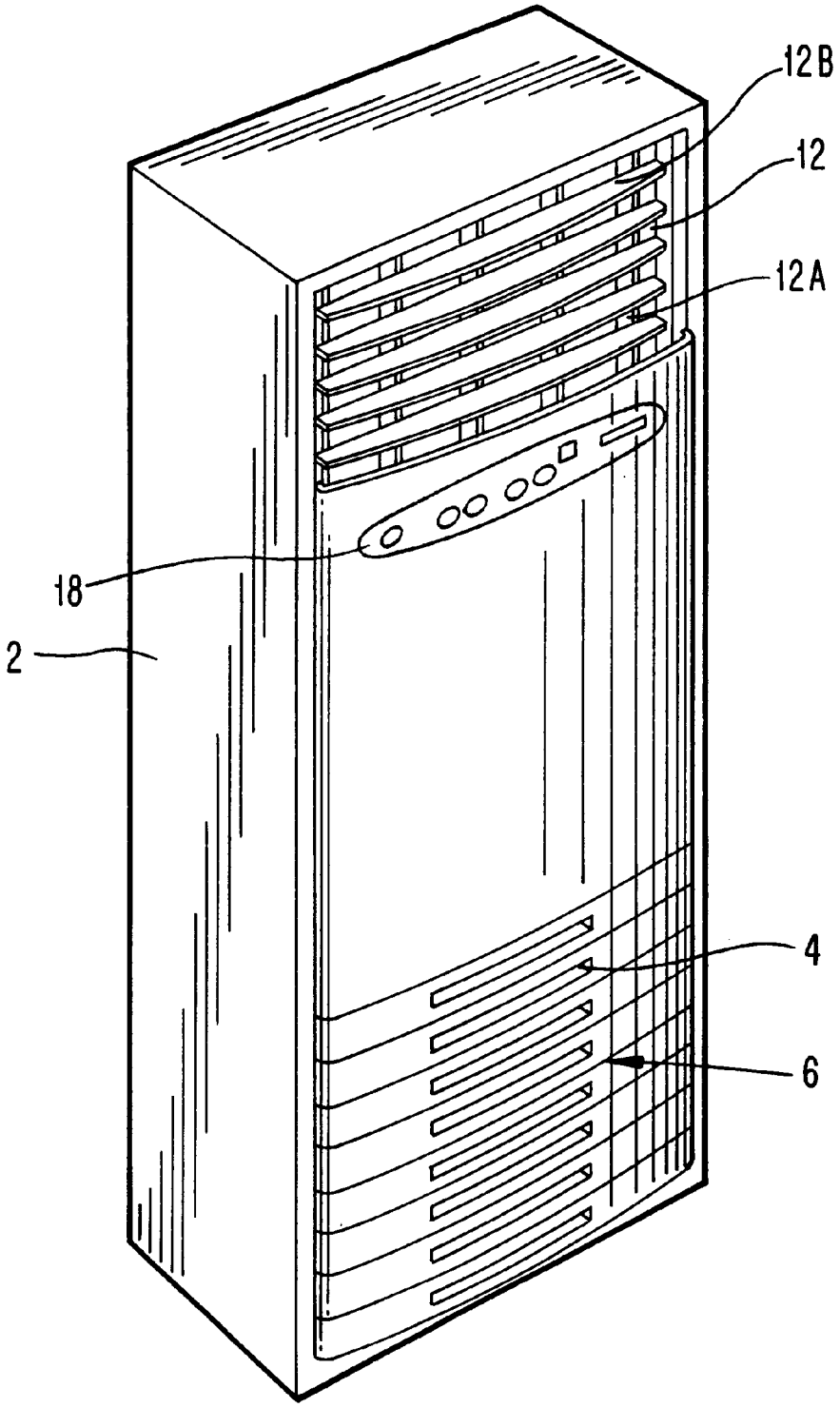
FIG. 1 (PRIOR ART)
FIG. 1 is a perspective view schematically showing the overall construction of a conventional air conditioner.
Figure 2:
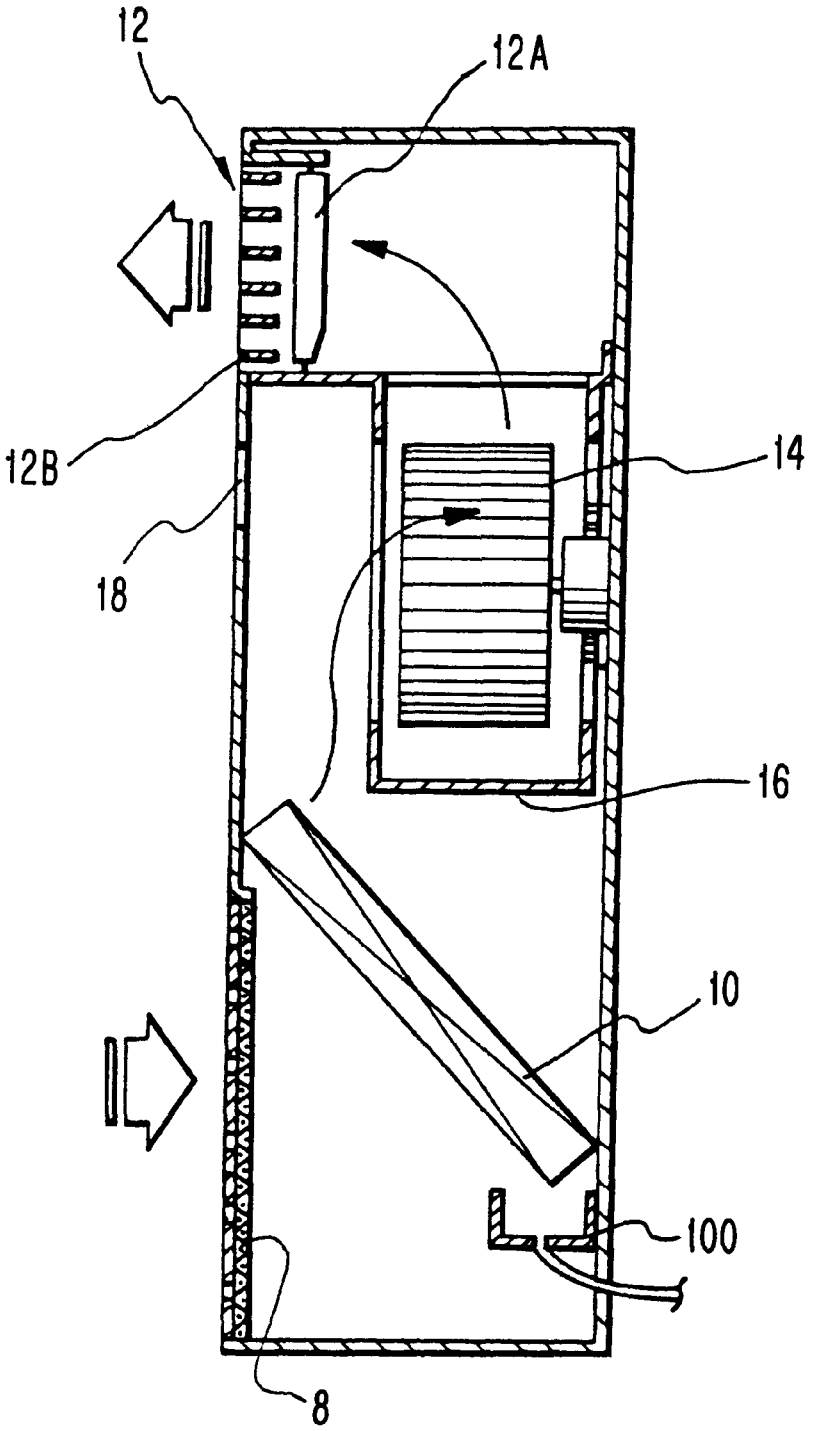
FIG. 2 (PRIOR ART)
FIG. 2 is a vertical sectional view schematically showing an inner construction of the conventional air conditioner.
Figure 3:
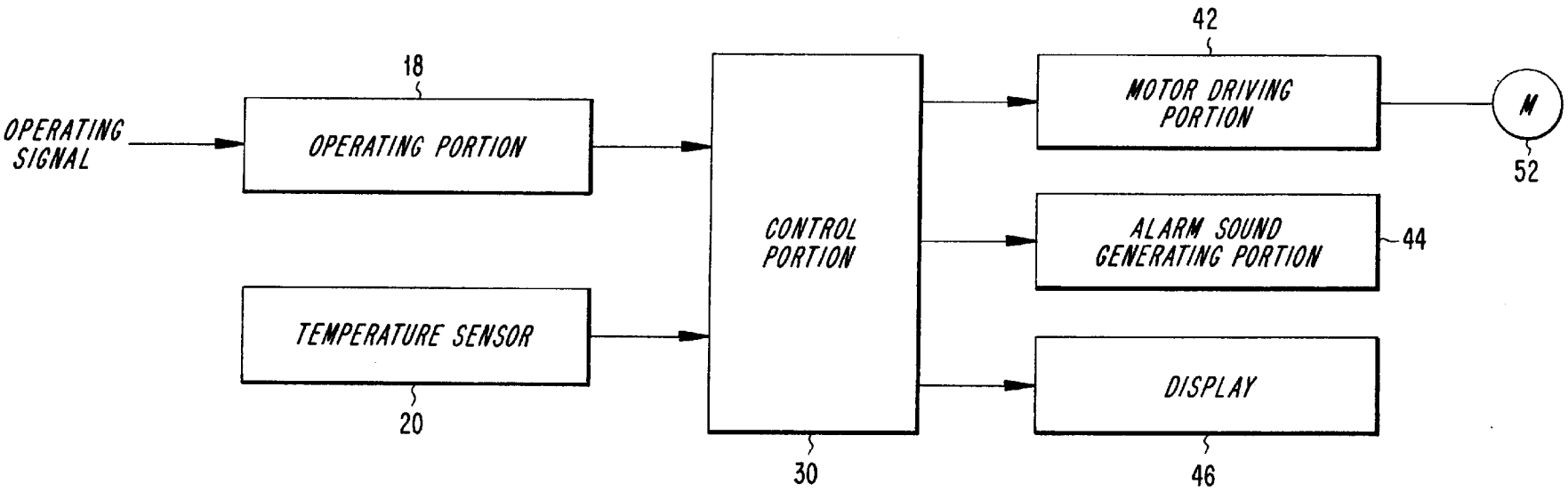
FIG. 3 is a schematic block diagram of a device for sensing condensed water of an air conditioner according to a preferred embodiment of the present invention.

FIG. 3 is a schematic block diagram of the device for sensing condensed water of the air conditioner according to a preferred embodiment of the present invention which comprises: operating portion 18, temperature sensor 20, control portion 30, motor driving portion 42, alarm sound generating portion 44, display 46, and compressor motor 52.

Figure 4:
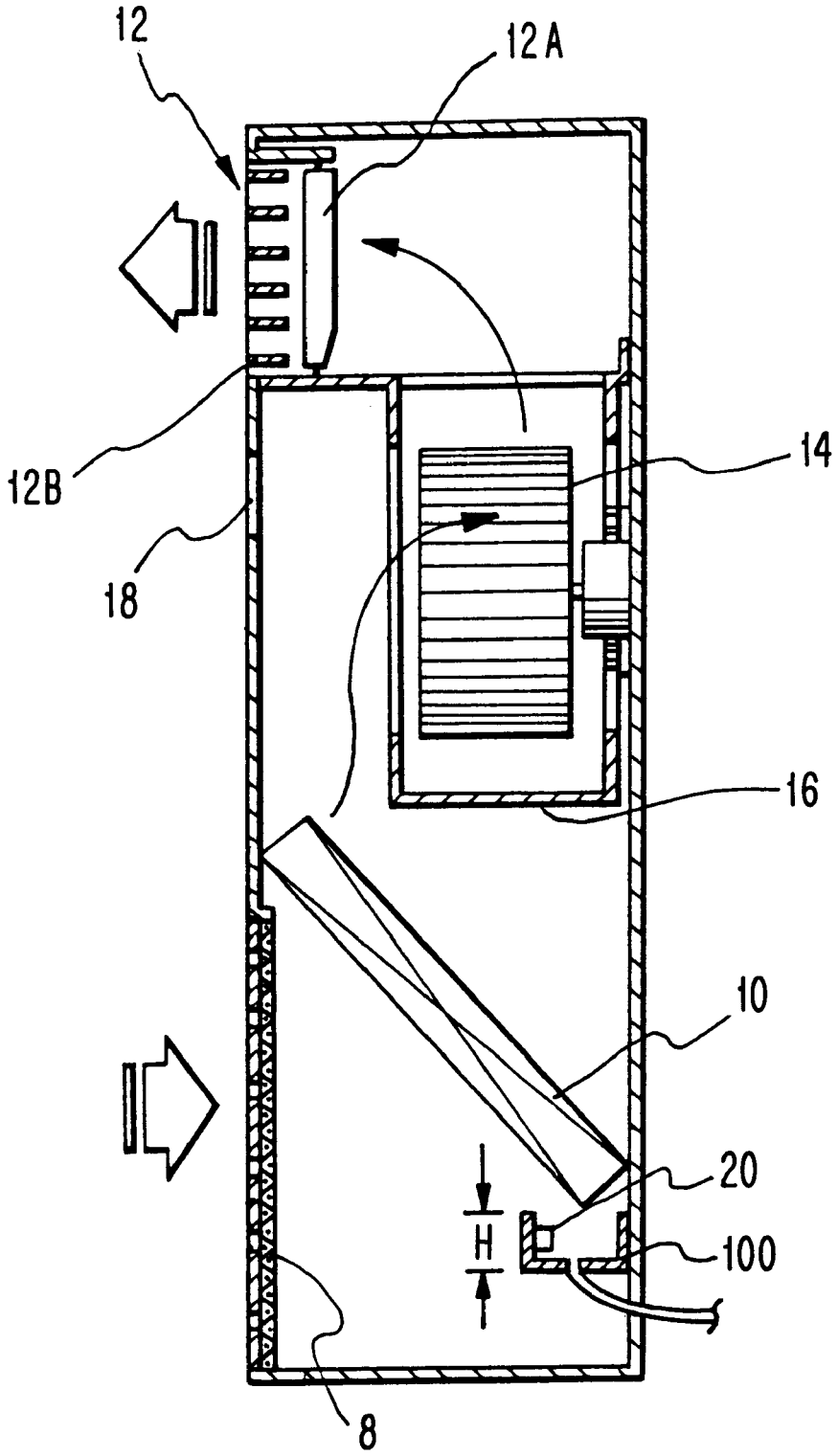
FIG. 4 shows the position where a temperature sensor depicted in FIG. 3 is mounted in a condensed water bucket.
Figure 5:
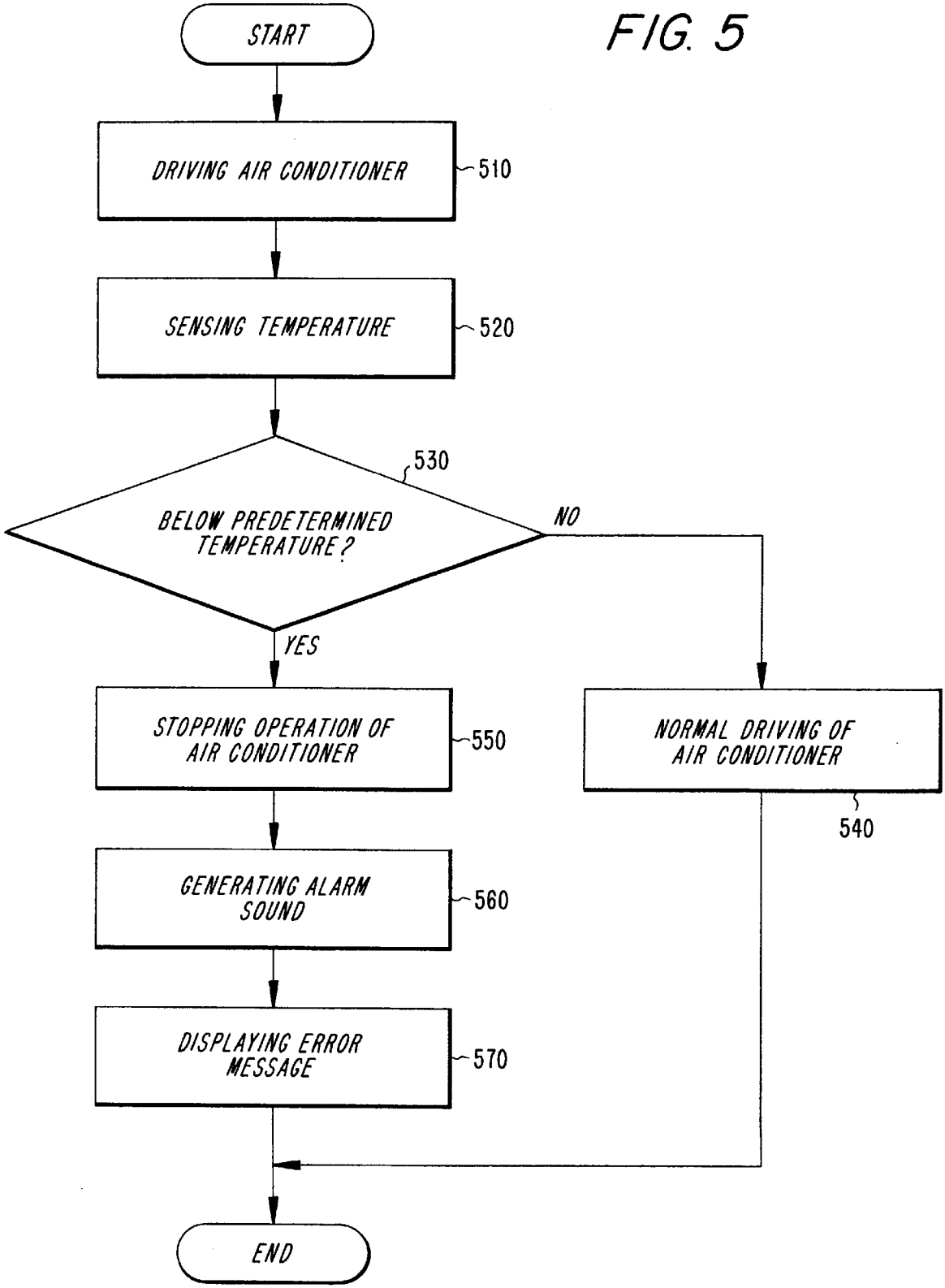
FIG. 5 is a flow chart showing the course of sensing the condensed water of the air conditioner in accordance with the preferred embodiment of the present invention.

As illustrated in FIG. 3, operating portion 18 generates a key signal for adjusting the operating mode (automation, cooling, dehumidifying, ventilating, heating, etc.) of the air conditioner, the start and stop of operating, and the flux and wind direction of the air discharged through outlet 12. As shown in FIG. 4, temperature sensor 20 is mounted within condensed water bucket 100 under indoor heat-exchanger 10 (desirably, at the middle of the height H of condensed water bucket 100), for sensing a temperature, and provides it for control portion 30.

Control portion 30 generates the control signal to operate motor driving portion 42 by the driving key signal from operating portion 18, and the control signal to compare the temperature detected by temperature sensor 20 with a reference temperature already set (e.g. 15 to 18° C.), for motor driving portion 42's continuously operating or operation stopping.

In the concrete, the temperature of condensed water is generally about 12° C., and therefore control portion 30 decides that condensed water does not collect in condensed water bucket 100 if the temperature detected by temperature sensor 20 is above the temperature already set (e.g. 15 to 18° C.), and that the temperature sensed by temperature sensor 20 is the room temperature, generating the control signal to continuously operate motor driving portion 42 until the room temperature reaches the temperature set by the user.

Control portion 30 also decides that condensed water collects in condensed water bucket 100 if the temperature detected by temperature sensor is below the temperature already set (e.g. 15 to 18° C.), and then generates the alarm control signal to alert users to the overflow of condensed water, simultaneously with generating the control signal to stop the operation of motor driving portion 42.

As shown in FIG. 3, compressor motor 52 is driven by motor driving portion 42 which operates by the driving control signal from control portion 30, to thereby drive the air conditioner, and stopped by the driving stop control signal from control portion 30. Alarm sound generating portion 44 generates the alarm sound by the alarm control signal from control portion 30, and display 46 is mounted on the front of the air conditioner and displays the error message that condensed water collects in condensed water bucket 100 (e.g. "CHECK DRAIN PANEL") by the alarm control signal from control portion 30.

The following detailed description relates to the operation of the device for and the method of sensing condensed water of the air conditioner constructed above, referring to FIGS. 3 to 6.

When a driving key signal is furnished from operating portion 18 to control portion 30 by the user's operation, control portion 30 generates the control signal to operate motor driving portion 42, and then compressor motor 52 is driven by motor driving portion 42 which operates by means of the driving control signal from control portion 30, thereby driving the air conditioner (Step 510).

During the operation of the air conditioner, moisture is generated by the state change of inner devices, caused by indoor heat-exchanger 10. As moisture increases, condensed water runs down into condensed water bucket 100 mounted under indoor heat-exchanger 10, before discharged to outside through the hose connected with the aperture formed in the bottom of condensed water bucket 100.

As illustrated in FIG. 4, the temperature is detected by temperature sensor 20 within condensed water bucket 100 mounted under indoor heat-exchanger 10, before furnished to control portion 30.

In case that the condensed water running down into condensed water bucket 100 is discharged to outside through the hose, the temperature sensed by temperature sensor 20 is above the temperature (e.g. 15 to 18° C.) set in control portion 30.

Accordingly, control portion 30 decides that the temperature sensed by temperature sensor 20 is the room temperature, and generates the control signal to continuously operate motor driving portion 42 until the temperature sensed approximates the desired temperature set by users. Motor driving portion 42 is continuously driven by the driving control signal from control portion 30, to continuously operate compressor motor 52, thereby normally driving the air conditioner (Steps 530 and 540).

When the temperature detected by temperature sensor 20 reaches the desired temperature set by users, control portion 30 generates the control signal to stop the operation of motor driving portion 42, and then motor driving portion 42 is stopped by the driving stop control signal from control portion 30, to halt the operation of compressor motor 52, thereby stopping the operation of the air conditioner.

When the aperture formed on the bottom of condensed water bucket 100 is stopped up with impurities such as dust, the condensed water which runs down into condensed water bucket 100 is not discharged to outside, continuously collecting in condensed water bucket 100, and thereby submerging temperature sensor 20 in the condensed water.

Accordingly, temperature sensor 20 detects the temperature (usually about 12° C.) of condensed water, which is below a predetermined temperature (15 to 18° C.) already set. Control portion 30 decides that condensed water collects in condensed water bucket 100, generating the control signal to alert user to the overflow of condensed water as well as the control signal to stop the operation of motor driving portion 42.

Motor driving portion 42 is stopped by the driving stop control signal from control portion 30. This causes compressor motor 52 to stop, to thereby halt the operation of the air conditioner (Steps 530 and 550). Simultaneously, the alarm sound is generated through alarm sound generating portion 44, by the alarm control signal from control portion 30 (Step 560), and the error message (e.g. "CHECK DRAIN PANEL") is displayed through display 46 mounted on the front of the air conditioner (Step 570).

Figure 6:
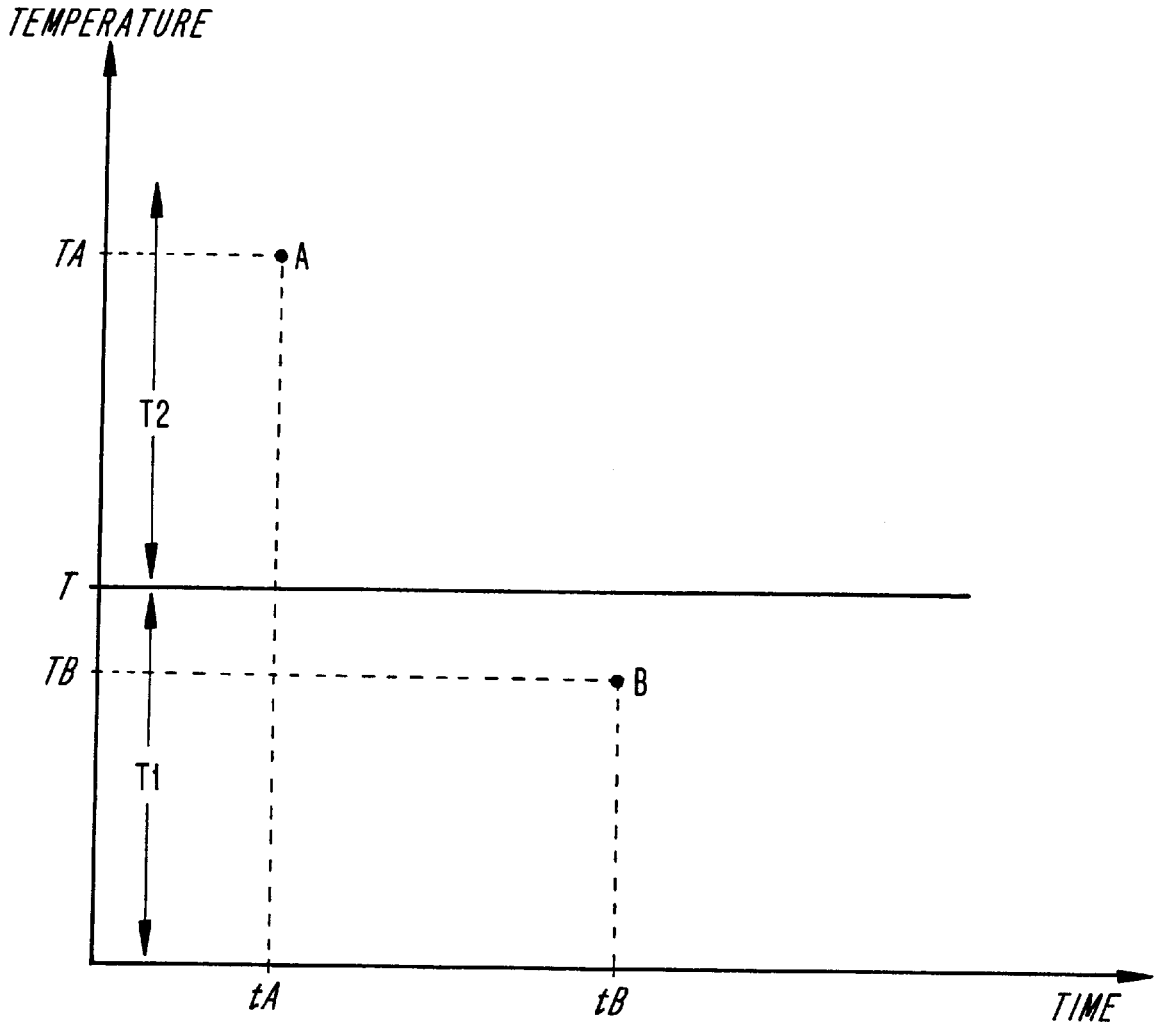
FIG. 6 graphically depicts filling of the condensed water bucket.

Referring to FIG. 6, the following description also relates to the operation of the device for and the method of sensing condensed water of the air conditioner according to the present invention.

As shown in "A" of FIG. 6, if the temperature $T_A$ detected through temperature sensor 20 at time $t_A$ is above a predetermined temperature (T=15 to 18° C.) already set, namely within region T2, control portion 30 decides that the temperature sensed by temperature sensor 20 is the room temperature, generating the control signal to continuously operate motor driving portion 42 until the temperature sensed by temperature sensor 20 reaches the desired temperature set by the user. Motor driving portion 42 is driven by the driving control signal from control portion 30, to operate compressor motor 52, thereby driving the air conditioner normally.

As depicted in "B" of FIG. 6, if the temperature $T_B$ detected through temperature sensor 20 at time $t_B$ is below the predetermined temperature (T=15 to 18° C.) already set, namely within region T1, control portion 30 decides that condensed water collects in condensed water bucket 100, generating the control signal to stop the operation of motor driving portion 42. Motor driving portion 42 is stopped by the driving stop control signal from control portion 30, to halt the operation of compressor motor 52, thereby stopping the air conditioner.

Additionally, the alarm sound is generated through alarm sound generating portion 44 by the alarm control signal from control portion 30, and the error message is displayed through display 46 as well.

As described above, if the temperature sensed by temperature sensor 20 mounted within condensed water bucket 100 is above the predetermined temperature already set, control portion 30 decides that the temperature detected by temperature sensor 20 is the room temperature, operating motor driving portion 42 for compressor motor 52 driving until the temperature sensed by temperature sensor 20 reaches the desired temperature set by the user. When condensed water collects in condensed water bucket 100, the temperature sensed by temperature sensor 20 is below the predetermined temperature already set. Motor driving portion 42 is stopped by the driving stop control signal from control portion 30, to halt the operation of compressor motor 52 and to alert users to the error through display 46 and alarm sound generating portion 44 by the alarm control signal from control portion 30.

As a result, the present invention senses the overflow of condensed water as well as the indoor temperature through temperature sensor 20 mounted within condensed water bucket 100 so that the break-downs of the electric parts in the air conditioner and the damage of the floor or furniture, caused by the overflow of condensed water can be prevented, thereby decreasing the cost of manufacture.

It will be apparent to those skilled in the art that various modifications and variations can be made in the device for and the method of sensing condensed water of the air conditioner of the present invention without departing from the spirit or scope of the invention. Thus, it is intended that the present invention cover the modifications and variations of this invention provided they come within the scope of the appended claims and their equivalents.

What is claimed is:

1. An air conditioner comprising:

an air inlet for admitting room air;

a heat-exchanger for changing a temperature of room air received from the air inlet;

a compressor for compressing refrigerant supplied to the heat exchanger;

a condensed water container disposed below the heat exchanger for collecting and draining condensed water received from the heat exchanger;

a temperature sensor disposed within a portion of the container situated between the inlet and the heat exchanger, the temperature sensor positioned for sensing a temperature of room air when the container contains less than an excessive amount of condensed water, and for sensing a temperature of condensed water when the container contains an excessive amount of condensed water; and a controller operably connected to the temperature sensor and the compressor for comparing the sensed temperature with a reference temperature for determining whether the temperature sensed is the temperature of room air or condensed water, and for shutting off the compressor in response to determining that the sensed temperature is a temperature of condensed water.

2. The air conditioner according to claim 1 further including an alarm generator connected to the controller for sounding an audio alarm in response to a determination that the sensed temperature is a temperature of condensed water.

3. The air conditioner according to claim 2 further including a display connected to the controller for displaying a warning message in response to a determination that the sensed temperature is a temperature of condensed water.

4. The air conditioner according to claim 1 wherein the reference temperature is in the range of 15° C. to 18° C.

5. The air conditioner according to claim 3 wherein the reference temperature is in the range of 15° C. to 18° C.

6. The air conditioner according to claim 1 further including a manual selector by which a user selects a desired temperature, the controller connected to the manual selector for shutting off the compressor when the sensed temperature corresponds to the selected temperature while it is simultaneously determined that the sensed temperature is a room air temperature.

7. A method of controlling an air conditioner comprising the steps of:

A) admitting room air through an inlet;

B) conducting the admitted room air through a heat-exchanger for heat exchanging the room air with coolant supplied to the heat exchanger by a compressor;

C) collecting condensed water from the heat-exchanger in a container;

D) sensing a temperature in a portion of the container disposed between the inlet and the heat-exchanger, whereby the sensed temperature is a temperature of room air when the container contains less than an excessive amount of condensed water and is a temperature of condensed water when the container contains an excessive amount of condensed water;

E) comparing the sensed temperature with a reference temperature for determining whether the sensed temperature is the temperature of room air or condensed water; and F) shutting off the compressor in response to determining that the sensed temperature is a temperature of condensed water.

8. The method according to claim 7 further including the step of sounding an alarm in response to a determination that the sensed temperature is a temperature of condensed water.

9. The method according to claim 7 further including the step of displaying a warning message in response to a determination that the sensed temperature is a temperature of condensed water.

10. The method according to claim 7 wherein the reference temperature is in the range of 15° C. to 18° C.

11. The method according to claim 8 wherein the reference temperature is in the range of 15° C. to 18° C.

12. The method according to claim 7 further including the step of comparing the sensed temperature with a selected temperature selected by a user when it is determined that the sensed temperature is a room air temperature, and shutting off the compressor when the sensed temperature corresponds to the selected temperature.

* * * * *